US010631619B2

(12) United States Patent
Alphin

(10) Patent No.: US 10,631,619 B2
(45) Date of Patent: Apr. 28, 2020

(54) BACKPACK WITH CHAIR CONVERSION

(71) Applicant: Alan Kent Alphin, Wilmington, NC (US)

(72) Inventor: Alan Kent Alphin, Wilmington, NC (US)

( * ) Notice: Subject to any disclaimer, the term of this patent is extended or adjusted under 35 U.S.C. 154(b) by 4 days.

(21) Appl. No.: 16/034,309

(22) Filed: Jul. 12, 2018

(65) Prior Publication Data

US 2019/0014889 A1 Jan. 17, 2019

Related U.S. Application Data

(60) Provisional application No. 62/531,407, filed on Jul. 12, 2017.

(51) Int. Cl.

| | |
|---|---|
| ***A45F 4/02*** | (2006.01) |
| ***A47C 1/14*** | (2006.01) |
| ***A47C 13/00*** | (2006.01) |
| ***A47C 9/10*** | (2006.01) |

(52) U.S. Cl.

CPC ..... *A45F 4/02* (2013.01); *A47C 1/146* (2013.01); *A47C 9/10* (2013.01); *A47C 13/00* (2013.01); *A45F 2004/026* (2013.01)

(58) Field of Classification Search

CPC .. A45F 4/02; A47C 1/146; A47C 9/10; A47C 13/00

USPC ..... 224/155

See application file for complete search history.

(56) References Cited

U.S. PATENT DOCUMENTS

| | | | | | |
|---|---|---|---|---|---|
| 1,140,997 | A * | 5/1915 | Minehart | A45C 9/00 | 190/8 |
| 2,973,888 | A * | 3/1961 | Beardsley | A47C 1/143 | 224/155 |
| 3,825,298 | A * | 7/1974 | Chipman | A45C 9/00 | 297/129 |
| 4,736,825 | A * | 4/1988 | Belfi | A45C 3/10 | 190/8 |
| 4,824,171 | A * | 4/1989 | Hollingsworth | A47O 1/146 | 297/351 |
| 5,190,350 | A * | 3/1993 | Hwang | A47C 1/143 | 297/226 |
| 5,205,610 | A * | 4/1993 | Reninger | A45C 9/00 | 297/17 |
| 5,385,390 | A * | 1/1995 | Freeman | A47O 7/425 | 297/380 |
| 5,560,524 | A * | 10/1996 | Brune | A45F 4/02 | 224/153 |

(Continued)

*Primary Examiner* — Justin M Larson
*Assistant Examiner* — Lester L Vanterpool

(57) ABSTRACT

A backpack is manipulable between a first configuration facilitating carrying by a user and a second configuration serving as a chair. The backpack comprises first and second sections, each defining a first and second surfaces and each including a pair of inwardly foldable wings. A web of fabric material flexibly couples the first section to the second section so that the two sections can be manipulated between the aforementioned configurations. A closure mechanism retains the first surface of the first section and the first surface of the second section in facing relation, following inward folding of the first and second pairs of wings and manipulation of the backpack into the first configuration, but is releasable to facilitate manipulation of the first section relative to the second section to thereby obtain a desired angle of recline therebetween.

23 Claims, 9 Drawing Sheets

(56) References Cited

U.S. PATENT DOCUMENTS 5,573,155 A * 11/1996 Sadler ..... A45F 4/02 224/155
5,584,422 A * 12/1996 Bond-Madsen ..... A47C 7/425 224/155
5,588,570 A * 12/1996 Zirbel ..... A45F 4/02 224/155
5,620,227 A * 4/1997 Brune ..... A41D 15/04 297/4
5,819,999 A * 10/1998 Tennant ..... A45F 4/02 224/155
5,944,379 A * 8/1999 Yates ..... A47C 7/021 297/129
5,988,465 A * 11/1999 Vitale ..... A45C 15/00 224/153
6,007,572 A * 12/1999 Baldwin ..... A47O 7/021 607/114
6,145,716 A * 11/2000 Caicedo ..... A45F 3/04 224/155
6,250,712 B1 * 6/2001 Livington ..... A47C 1/146 297/129
D449,947 S * 11/2001 Schoefer ..... D6/368
6,547,110 B2 * 4/2003 O'Hare ..... A45F 3/08 224/155
D485,432 S * 1/2004 Desrochers ..... D3/214
6,848,746 B2 * 2/2005 Gentry ..... A47C 7/021 297/380
7,438,356 B2 * 10/2008 Howman ..... A47C 7/021 297/17
8,262,157 B2 * 9/2012 Novak ..... A47C 1/146 297/16.2
9,596,939 B1 * 3/2017 Helman ..... A47O 4/52
2003/0106915 A1 * 6/2003 Jo ..... A45F 4/02 224/155
2007/0012735 A1 * 1/2007 Lee ..... A45F 3/08 224/155
2008/0042379 A1 * 2/2008 Amran ..... A45F 4/02 280/30
2009/0090751 A1 * 4/2009 D'Alessandro ..... A45F 4/02 224/155
2011/0124953 A1 * 5/2011 Novak ..... A47C 1/146 600/27
2015/0150357 A1 * 6/2015 Ferreira ..... A45F 4/02 224/155
2018/0317635 A1 * 11/2018 Quon-Chow ..... A45F 4/02

* cited by examiner

BACKPACK WITH CHAIR CONVERSION

CROSS REFERENCE TO RELATED APPLICATION

This application claims the benefit of priority of earlier filed U.S. Provisional Patent Application Ser. No. 62/531,407 entitled BACKPACK WITH CHAIR CONVERSION and filed by Alan Kent Alphin on Jul. 12, 2017, the entire disclosure of which is incorporated herein by reference.

BACKGROUND OF THE DISCLOSURE

1. Technical Field

The present invention relates to backpacks and, more particularly, to backpacks which are manipulable between a first form suitable for wearing, as to facilitate the carrying and transportation of articles, and a second form enabling the backpack—or a part thereof—to perform an alternative function, such as that of a chair or another support.

2. Discussion of the Background Art

Those engaging in such activities as hiking, bicycling, camping, going to the beach, and similar outdoor activities often find themselves in need of a chair or other support structure. The manner in which this need is addressed, if at all, may depend as much or more upon the nature of the activity itself as upon the distance the participant must traverse before starting (or interrupting) the activity. If an intended camp site or beach location is not too far from one's car and the distance will be traversed by foot, many will opt to hand-carry one or more folding chairs and even to make separate trips for such other gear as tents, sleeping bags, or the like. Where the distance to be traveled is long and over variable terrain, as is often the case for a hike or bicycle ride, or if the activity incorporates paddling as the means of locomotion (i.e., paddle-boarding, canoeing, or kayaking), conventional folding chairs are too bulky and/or unwieldy to be practical.

Backpacks which integrate a folding chair accessory with the traditional article storage capacity have also been proposed to obviate the need to carry a folding chair by hand. In U.S. Pat. No. 5,409,291 entitled "Combined Chair and Backpack" and filed by Lamb et al. on Aug. 6, 1993, for example, there is shown a combined chair and backpack which includes a conventional folding lawn chair type frame having an upper transverse frame member pivotally connected to an upper portion of a pack frame. While such a structure frees the wearer from the necessity of hand-carrying a chair support to the point of use, it is nonetheless large, bulky and cumbersome for the wearer. The present inventor has recognized that a continuing need exists for a backpack article which is not merely manipulable into a chair, but also compact, lightweight, and fully compatible with a wide variety of sports activities so that a more functional outdoor experience conducive to sporting and sitting is enabled.

SUMMARY OF THE INVENTION

The aforementioned need is addressed, and an advance is made in the art, by a backpack manipulable between a first configuration adapted for being worn by a user and for carrying and transporting articles and a second configuration adapted to support a seated user. In embodiments, bulkiness is scrupulously avoided by use of compact seat and back support structures which are foldable relative to one another, with each of the support structures employing a flexible wing dimensioned and arranged to fold inwardly (i.e. toward a center line of the corresponding support structure) along respective fold lines. The resulting structure has a narrow width profile until the chair functionality is needed, making it ideal for those sports activities which emphasize balance and/or endurance such, for example, as cross-country hiking or bicycling and paddle-boarding, but it also defines an interior storage compartment for the transport of those items which the participant deems essential to his or her performance and/or safety in the same manner as a conventional sports backpack. Such items may include, but are not limited to, high energy snacks, water, towels, a change of clothes, bicycle tires and/or tubes, tools, and a variety of other accessories. While unfolded, terminal attachment regions of each wing are interconnected by releasable, adjustable length straps, the seat and support surfaces defined by the backpack are retained in an alignment which provides support to a seated user.

In one or more embodiments, a backpack manipulable between a first configuration adapted for being worn by a user and for carrying and transporting articles and a second configuration adapted to support a seated user, comprises (i) a first section, the first section defining a first interior surface and a first exterior surface and including a first peripheral sidewall portion extending from and contiguous with the first interior surface of the first section to thereby form a first portion of an interior storage compartment; (ii) a second section, the second section defining a first interior surface and a first exterior surface and including a second peripheral sidewall portion extending from and contiguous with the first interior surface of the second section to thereby form a second portion of an interior storage compartment; (iii) a reversible closure mechanism dimensioned and arranged to retain edges of the first periperal sidewall portion and the second peripheral sidewall portion in aligned arrangement to thereby form an enclosed interior storage compartment from the first and second sections; (iv) a first inwardly foldable wing having a first wing section extending from a first fold line along one of the first interior surface or the first exterior surface of the first section, the first wing section including a first elongated stiffener extending in a direction parallel to the first fold line, and a second wing section extending from a second fold line along one of the first interior surface or the first exterior surface of the second section, the second wing section including a second elongated stiffener extending in a direction parallel to the second fold line, wherein the first wing section extends from the second wing section along a first transverse fold line; and (v) a second inwardly foldable wing having a third wing section extending from a third fold line along one of the first interior surface or the first exterior surface of the first section, the third wing section including a third elongated stiffener extending in a direction parallel to the third fold line, and a fourth wing section extending from a fourth fold line along one of the first interior surface or the first exterior surface of the second section, the fourth wing section including a second elongated stiffener extending in a direction parallel to the second fold line, wherein the third wing section extends from the fourth wing section along a second transverse fold line.

In some embodiments, the first and third fold lines, and the first and second elongate stiffeners are each parallel to one another. In addition, the second and fourth fold lines, and the third and fourth elongate stifffeners are each parallel to one another.

In some embodiments, each of the first and second inwardly foldable wings are formed separately from the material defining the the interior surfaces of the first and second sections, the former being respectively fastened, attached or secured to the latter along an attachment region proximate the corresponding fold lines. That is, the inwardly foldabe wings extend from respective interior surfaces of the first storage compartment portion and second storage compartment portion, respectively. In alternative embodiments, the inwardly foldable wings are formed integrally and contiguously with the segment(s) of material defining the interior surfaces of the first and second sections of the backpack. In such embodiments, the wing sections are folded into the storage compartment formed when the first and second sections are secured together by the closurer mechaniism.

In other embodiments consistent with the present disclosure each of the first and second inwardly foldable wings are formed separately from the material defining the exterior surfaces of the first and second sections, the former being respectively fastened, attached or secured to the latter along one or more attachment region(s) proximate the corresponding fold lines. Here, the inwardly foldable wings extend from respective exterior surfaces of the first storage compartment portion and second storage compartment portion, respectively. Alternatively, the inwardly foldable wings may be formed integrally and contiguously with the segment(s) of material defining the exterior surfaces of the first and second sections of the backpack. These arrangements increase the capacity of the interior storage compartment for other items, since when not needed to form the chair configuration of the backpack, the inwardly foldable wings are folded into their inwardly folded positions outside of the compartment. In such embodiments, the wing sections are folded into the storage compartment formed when the first and second sections are secured together by the closure mechanism.

In embodiments, first and second pairs of adjustable length straps, the first strap of a pair of straps having a proximal end secured to a corresponding attachment region of the first section and the second strap of a pair of straps having a proximal end secured to a corresponding attachment region of the second section. In some embodiments, the first interior surfaces of the first and second sections, serve as back and bottom support surfaces, respectively. In alternative embodiments, the first exterior surfaces of the first and second sections serve as the back and bottom support surfaces, respectively. In each case, the respective support surfaces are maintained in positions suitable to provide support to a seated user by coupling the first strap of each pair of straps to the corresponding second strap of the pair. Any conventional closure mechanism for securing the straps together (clasp, buckle, etc) may be utilized.

In some embodiments, the backpack includes provisions for attaching one or more accessory straps can also be made. In one embodiment, first and second strap securement mechanisms are secured to to surfaces of the backpack exterior to the interior storage compartment. In one embodiment, each respective end of an accessory strap dimensioned and arranged to encircle a surfboard or paddleboard—while the backpack is worn by a user—is detachably securable to a corresponding one of the securement mechanisms. In another embodiment, first and second accessor straps, each having a loop at one end for encircling a paddleboard or surfboard and at the other a releasable securing mechanism detachably securable to a corresponding one of the first and second strap securement mechanism.

While the methods and apparatus are described herein by way of example for several embodiments and illustrative drawings, those skilled in the art will recognize that inventive backpack articles convertible into a chair are not limited to the embodiments or drawings described. It should be understood, that the drawings and detailed description thereto are not intended to limit embodiments to the particular form disclosed. Rather, the intention is to cover all modifications, equivalents and alternatives falling within the spirit and scope of the apparatus and article defined by the appended claims. Any headings used herein are for organizational purposes only and are not meant to limit the scope of the description or the claims. As used herein, the word "may" is used in a permissive sense (i.e., meaning having the potential to), rather than the mandatory sense (i.e., meaning must). Similarly, the words "include", "including", and "includes" mean including, but not limited to.

BRIEF DESCRIPTION OF THE DRAWINGS

The foregoing summary and the following detailed description of the preferred embodiments of the present invention will be best understood when read in conjunction with the appended drawings, in which the same reference numbers will be used throughout the drawings to refer to the same or like parts.

DETAILED DESCRIPTION OF THE INVENTION

Embodiments of the present disclosure relate to backpacks manipulable between a first configuration, adapted for being worn by a user and for carrying and transporting articles, and a second configuration adapted to support a seated user. The inventor herein has recognized that for a backpack to be worn during activities requiring endurance, balance, and/or agility, it is necessary to provide a compact and lightweight structure that is relatively thin and narrow (e.g., having a thickness on the order of from about 5 cm to about 20 cm and a width on the order of from about 30 cm to about 45 cm). To this end, embodiments consistent with the present disclosure utilize two support sections which are respectively manipulable between a first orientation, in which corresponding support surfaces reside in parallel planes so that the two sections may be secured to one another by a closure mechanism so as to form an interior storage compartment, and a second orientation in which the corresponding support surfaces diverge so as to provide surfaces for supporting a seated user. Integrally formed with, or attached to a respective lateral side of, each of the support surfaces are an associated pair of folding wings. Each of the wings folds inwardly (i.e., in a direction toward a longitudinal axis bisecting the first and second support surfaces. When respective sections of each folding wing are secured to one another by straps, the support structures are retained in the second orientation to support a seated user.

A variety of compact, backpack convertible chair structures—which can be comfortably carried yet quickly and easily unfolded and manipulated into the chair configuration—are contemplated by the inventor herein, and for ease of understanding a number of these are depicted in the Figures and will now be described in detail.

Figure 1A:
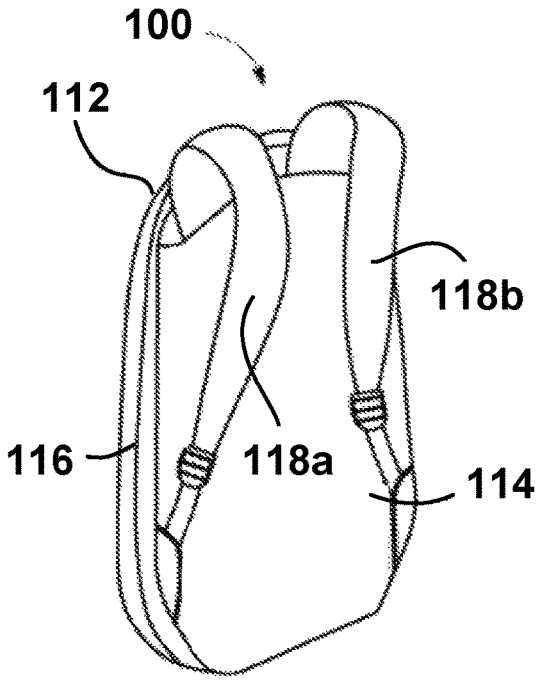
FIG. 1A is a rear perspective view depicting a backpack convertible into a chair structure according to an embodiment consistent with the present disclosure, the backpack being shown in a closed configuration enabling it to be worn by a user.
Figure 1B:
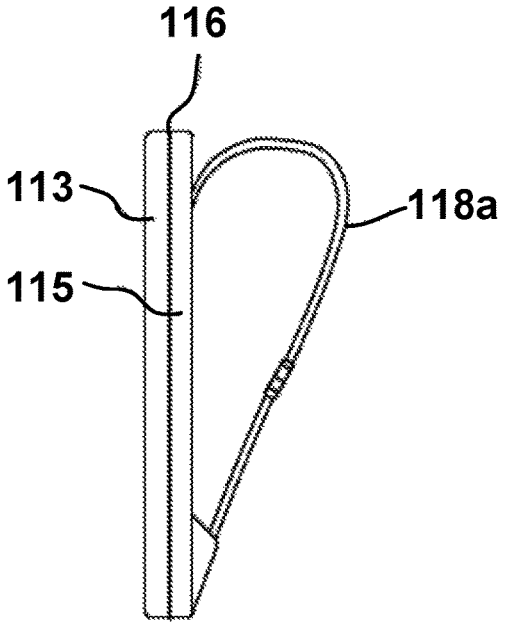
FIG. 1B is a side elevation view of the embodiment of the backpack depicted in FIG. 1A.

With initial reference to FIG. 1A, there is shown a rear perspective view depicting a backpack 100 convertible into a chair according to one or more embodiments consistent with the present disclosure, the backpack being shown in a closed ("first") configuration enabling it to be worn by a user. FIG. 1B is a side elevation view of the embodiment of the backpack 100 depicted in FIG. 1A. The backpack 100 includes a front ("first") section 112, a rear ("second") section 114. Each of the first and second sections has a peripheral sidewall, indicated generally at 113 and 115, respectively (FIG. 1B). A closure mechanism 116 secures the first and second sections together. In the illustrative embodiment of FIGS. 1A and 1B, closure mechanism 116 comprises a zipper dimensioned and arranged to secure an edge 113*a* (FIG. 2B) of peripheral sidewall 113 to a corresponding edge 115*a* (FIG. 2B) of peripheral sidewall 115. A pair of shoulder straps, indicated generally at 118*a* and 118*b* enable to the backpack 100 to be worn by a user until conversion into a chair structure is desired.

First section 112 and second section 114 thus define respective halves which can be secured together, as by closure mechanism 116, in order to form an interior compartment dimensioned to accommodate the storage of items consistent with use as a conventional backpack. The two halves are separated—whether to access the interior of the interior compartment or to unfold the backpack into a chair—by unzipping closure mechanism 116 along an inverted U-shaped path defined by the aligned edges of peripheral sidewalls 113 and 115.

Figure 2A:
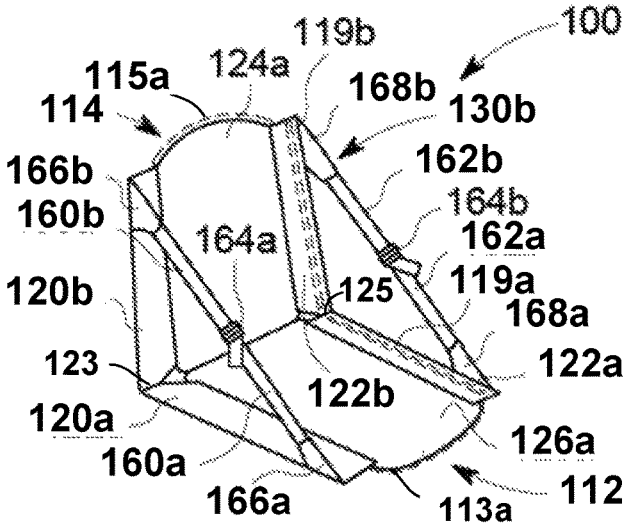
FIG. 2A is a partial perspective view of the embodiment of a backpack depicted in FIGS. 1A and 1B, the backpack being shown in an open configuration in which the front and rear sections, as well as the inwardly folding wing sections have been unfolded to provide back support to a seated user.
Figure 2B:
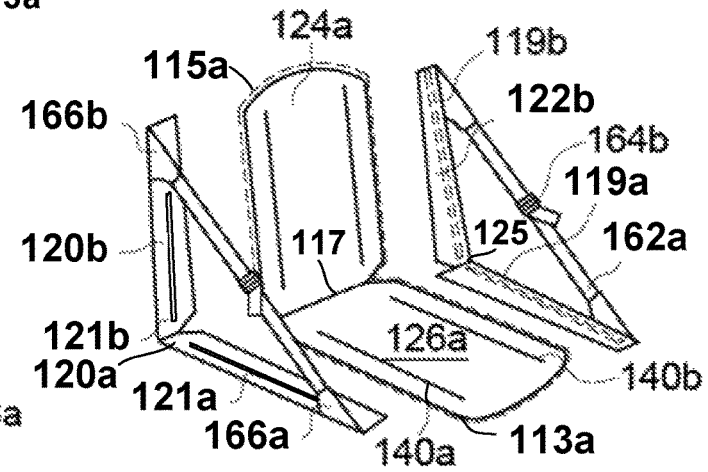
FIG. 2B is an exploded, partial perspective view of the embodiment of a backpack depicted in FIGS. 1A to 2A, depicting the regions of attachment along which inwardly folding wing sections are secured to a corresponding central support section to form a folding chair structure in accordance with the present disclosure.

FIG. 2A is a partial perspective view of the backpack 100, the backpack 100 being shown in FIG. 2A in an open ("second") configuration. FIG. 2B is an exploded, partial perspective view of the backpack 100 depicted in FIG. 2A. In the second configuration, back support surface 124*a* and bottom ("seat") support surface 126*a* are defined by second section 114 and first section 112, respectively. When in the chair defining positions depicted in FIGS. 2A and 2B, surfaces 124*a* and 126*a* are disposed within planes which diverge in a direction away from a common fold line indicated generally at 117 (FIG. 2B). In these chair defining positions, the first and second surfaces 124*a* and 126*a* contact and provide back and seat support, respectively, to the body of a seated user (not shown). In one or more embodiments consistent with the present disclosure, first section 120*a* of left ("first") inwardly folding wing 120 and first section 122*a* of right ("second") inwardly folding wing 122 are affixed, fastened, or otherwise secured to lower or front ("first") section 112. Likewise, second section 120*b* of inwardly folding wing 120 and second section 122*b* of inwardly folding wing 122 are affixed, fastened, or otherwise secured to upper or rear ("second") section 114. As best seen in FIG. 2B, wing section 120*b* extends from wing section 120*a* along a first transverse fold line 123 while wing section 122*b* extends from wing section 122*b* along a second transverse fold line 125. In embodiments consistent with the present disclosure, fold lines 117, 123 and 125 are collinear.

Figure 2C:
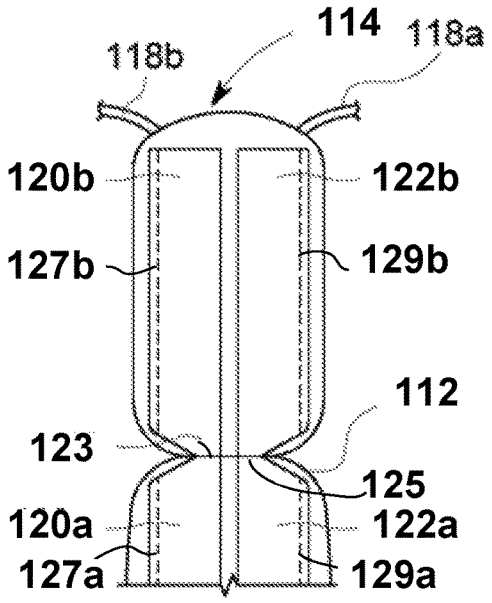
FIG. 2C is a partial elevation view of the embodiment of a backpack depicted in FIGS. 1A to 2B, the backpack being in an intermediate configuration with the front and rear sections unfolded to expose the interior storage compartment and inwardly folded wing sections.

Turning briefly to FIG. 2C, which is a partial elevation view of backpack 100 in an intermediate configuration with the front and rear sections unfolded to expose the interior storage compartment and inwardly folded wing sections, it can be seen that first folding wing 120 is inwardly foldable along fold lines 127*a* and 127*b*, while second folding wing 122 is inwardly foldable along fold lines 129*a* and 129*b*.

Returning to FIGS. 2A and 2B, it will be seen that backpack 100 further includes a first strap assembly having a first ("lower") retention strap 160*a* attached at a proximal end to first wing section 120*a* of first wing 120, by reinforcing web 166*a*. The first strap assembly of backpack 100 further includes second ("upper") retention strap 160*b* attached at its proximal end to second wing section 120*b* of first wing 120, by reinforcing web 166*b*. Likewise, backpack 100 further includes a second strap assembly having a lower retention strap 162*a*, the proximal end of which is attached at a proximal end to first wing section 122*a* of second wing 122, by reinforcing web 168*a*. The second strap assembly of backpack 100 further includes second strap assembly ("upper") that includes upper retention strap 162*b* attached at a proximal end to second wing section 122*b* of second wing 122, by reinforcing web 168*b*.

To maintain the backpack in the open, chair-defining configuration depicted in FIG. 2A, each of the aforementioned strap assemblies of backpack 100 includes a corresponding connector assembly 164*a*, 164*b* dimensioned and arranged to selectively couple or latch the free ("distal") end of each retention strap. Thus, connector assembly 164*a* selectively couples the distal end of lower strap 160*a* to the distal end of upper retention strap 160*b*, while connector assembly 164*b* selectively couples the distal end of retention strap 162*a* to the distal end of retention strap 162*b*. Preferably, each connector assembly 164*a* and 164*b* is dimensioned and arranged to accommodate strap length adjustments to accommodate users of various body lengths and types.

In some embodiments, the upper and/or lower straps comprise woven webbing material such, for example, as nylon, durable textile fibers, or the like, and the connectors 164*a* and 164*b* comprise clips and/or buckles to obtain a suitable degree of adjustability in length. Adjustability in length is desirable as it permits the user to control the width dimension of the back and bottom support provided and defined by support surfaces 124*a* and 126*b*, respectively.

It will, of course, be readily appreciated by those skilled in the art that other types of connectors besides straps and/or buckles may be used to control the length of the upper and lower straps, as upper strap 160*b* and lower strap 160*b*. In addition or by way of illustrative alternative, instead of utilizing a single, fixed point of attachment between the proximal end of each strap, as the connection of strap 160*a* to reinforcing web 166*a* is depicted in FIGS. 2A and 2B, multiple points of attachment—from which the user may select to obtain the desired width of support—may be provided between each reinforcing web and strap. It suffices to say that any length adjustable method of securing the respective pairs of upper and lower wing sections together may be employed without departing from the spirit and scope of the present disclosure.

FIG. 2B depicts illustrative regions of attachment as regions 119*a*, 119*b*, 121*a*, and 121*b* along which the inwardly folding wing sections 120*a*, 122*a*, 120*b*, and 122*b*, respectively are affixed, attached or otherwise secured to regions, as for example, to aligned regions 140*a* and 140*b* of surface 126*a*. FIG. 2C is a partial elevation view of backpack 100 depicted in FIGS. 1A to 2B, the backpack being in an intermediate configuration with the front and rear sections unfolded to expose the interior storage compartment and inwardly folded wing sections. Comparing FIGS. 1A and 1B to FIGS. 2A to 2C, it will be readily ascertained that the interior compartment is bounded, and thus defined by, the interior surface of peripheral side walls 113 and 115 together with support surfaces 124*a* and 126*a*, with the inwardly folding wings fitting within and being concealed by the interior compartment while backpack 100 is in the folded and closed configuration of FIGS. 1A and 1B.

Figure 3A:
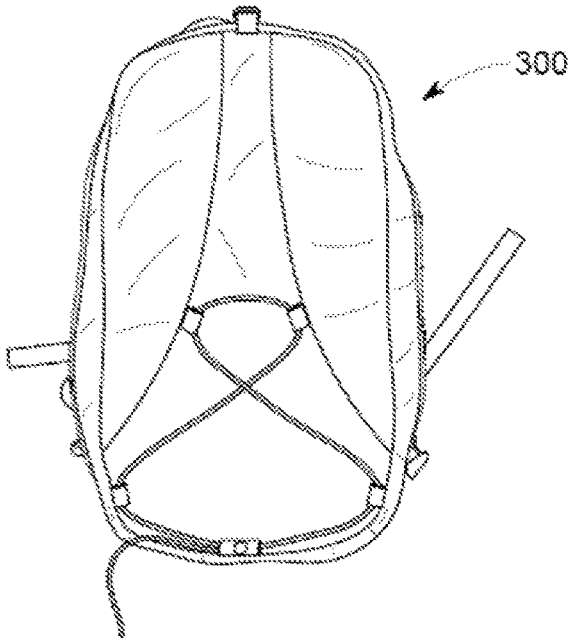
FIG. 3A is a front elevation view of a backpack according to a further embodiment consistent with the present disclosure, the backpack being shown in a closed configuration suitable for wearing by a user.
Figure 3B:
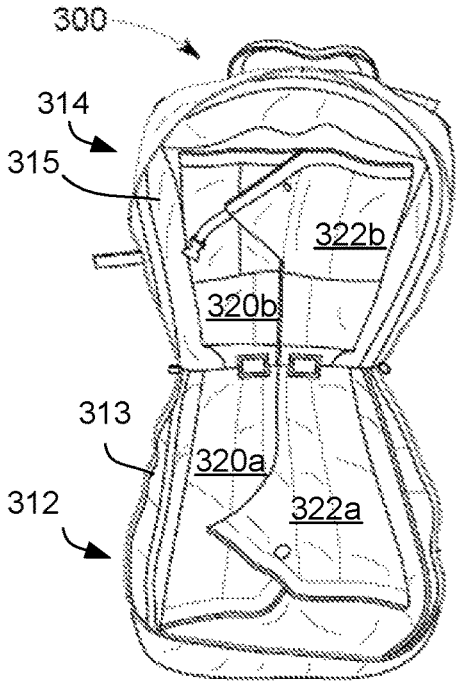
FIG. 3B is a perspective view of the embodiment of a backpack depicted in FIG. 3A, the backpack being in an intermediate position in which the front and rear sections have been sufficiently separated from one another as to expose an interior compartment and respective pairs of inwardly folding wing sections still in their inwardly folded positions.

FIG. 3A is a front elevation view of a backpack 300 constructed in accordance with another embodiment consistent with the present disclosure, the backpack 300 being shown in a closed configuration suitable for wearing by a user. FIG. 3B depicts 300 backpack being in an intermediate position in which the front section 312 and rear section 314 have been sufficiently separated from one another as to expose an interior compartment. The interior compartment is defined in part by peripheral side wall portions 313 and 315 as well as interior surfaces of section 312 and 314, respectively. Within the storage compartment are disposed corresponding pairs of inwardly folding wing sections, these being indicated generally at 320*a* and 322*a* and 320*b* and 322*b*, respectively, while they are in their inwardly folded positions. To maintain the wings in their respective positions, snaps indicated generally at 330 and 332 (FIG. 3C) may optionally be utilized. Alternative fastening structures, as for example, buttons, ties, buckles, or hook and loop fasteners, may alternative be utilized, or these structures may be omitted altogether. An advantage of including them is that a pocket can be formed between overlapping or fastened pairs of wing sections to, for example, isolate a first group of one or more stored items from a second group of one or more stored items.

Figure 3C:
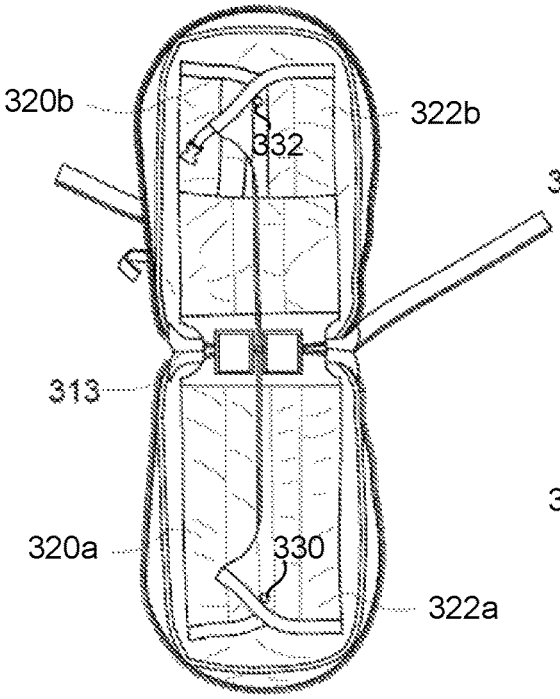
FIG. 3C is a perspective view of the embodiment of a backpack depicted in FIGS. 3A and 3B, the backpack being in an intermediate position in which the front and rear sections have been separated from one another so as to lie in a common plane, still exposing the interior compartment and respective pairs of inwardly folded wing sections.

FIG. 3C is a perspective view of backpack 300 depicted in FIGS. 3A and 3B, the front section 312 and rear section 314 being in a more advanced (i.e., completely open) intermediate position wherein the back support surface 324 and bottom support surface 326 are oriented in a common plane, facing upwardly and fully exposing the contents of the interior compartment, which at a minimum includes inwardly folding wing sections 320*a* and 320*b* of first inwardly folding wing 320 and inwardly folding wing sections 322*a* and 322*b* of second inwardly folding wing 322.

Figure 3D:
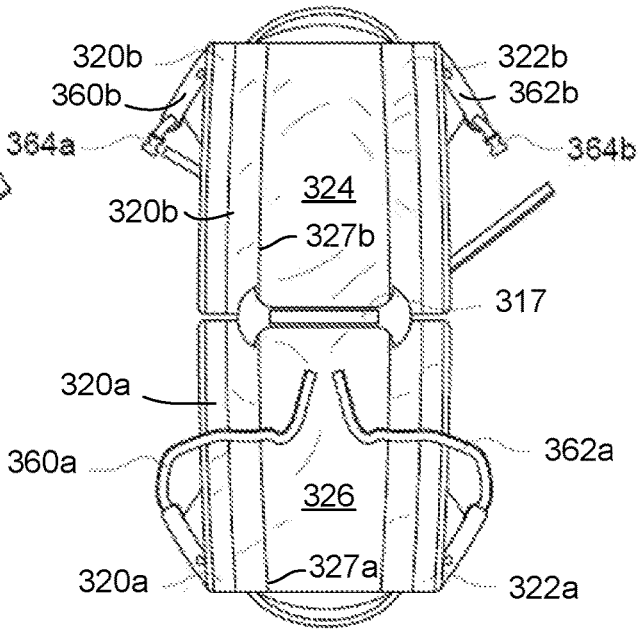
FIG. 3D is a perspective view of the embodiment of a backpack depicted in FIGS. 3A to 3C, the front and rear sections being in the same intermediate positions as depicted in FIG. 3C but the inwardly folding wing sections being completely unfolded.

FIG. 3D is a perspective view of backpack 300, wherein the front and rear sections are in the same advanced intermediate position as depicted in FIG. 3C but with the inwardly folding wing sections 320 and 322 being completely unfolded. By way of illustrative example, wing sections 320*a* and 320*b* of folding wing 320 are folded along fold lines 327*a* and 327*b*, respectively. A such, the difference between FIGS. 3C and 3D is that the folding wing sections 320*a*, 320*b* and 322*a*, 322*b* are in unfolded positions ready for corresponding attachment using the first pair of lower and upper strap sections, indicated generally at 360*a* and 360*b*, and the second pair of lower and upper strap sections, indicated generally at 362*a* and 362*b*, respectively. Support surfaces 324 and 326 are relatively manipulable along a fold line 317 disposed therebetween.

Figure 4A:
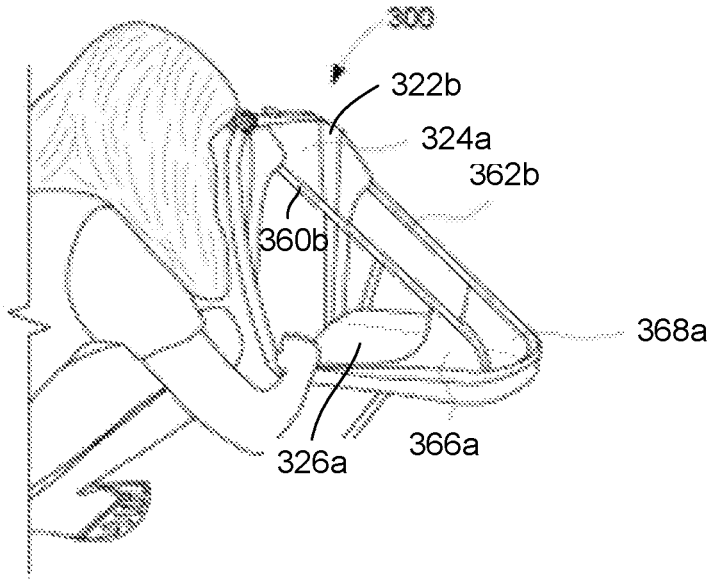
FIG. 4A is perspective view of the embodiment of a backpack depicted in FIGS. 3A to 3D, manipulated into and retained in a chair configuration using straps dimensions and arranged to secure the folding wing sections to one another.
Figure 4B:
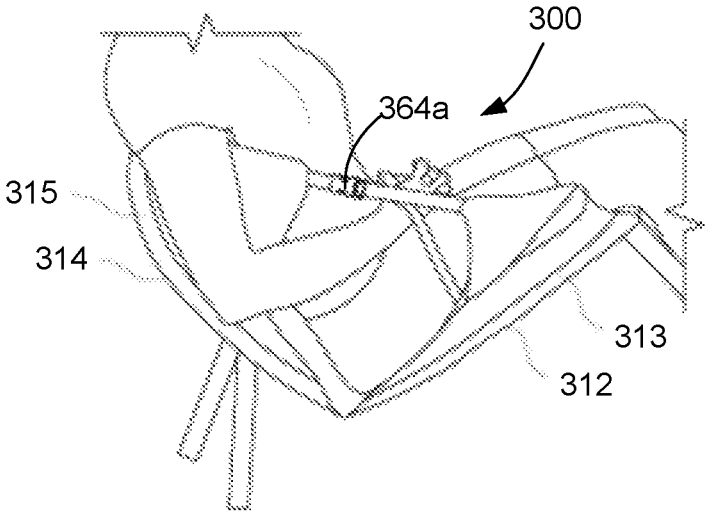
FIG. 4B is a perspective view of the embodiment of a backpack depicted in FIGS. 3A to 4B, showing the backpack converted into a chair and supporting a user in a knees-bent, semi-recumbent position consistent with the present disclosure.

FIG. 4A is perspective view of the exemplary backpack depicted in FIGS. 3A to 3D, manipulated into and retained in an initial chair configuration with respective pairs of upper and lower straps being attached to one another. In the same manner as described in connection with the discussion of FIGS. 1A to 2C. FIG. 4B depicts backpack 300, following manipulation into the chair configuration shown in FIG. 4A, the backpack 300 supporting a user in a knees-bent, semi-recumbent position as might be assumed by a user resting in the surface of a paddleboard.

Figure 5A:
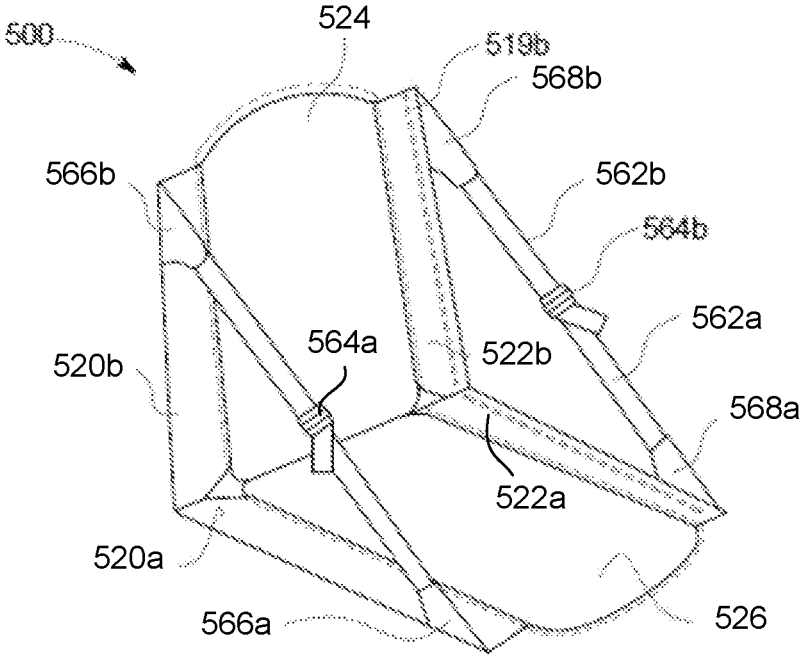
FIG. 5A is a partial perspective view of another embodiment of a backpack convertible to a chair consistent with the present disclosure, the backpack being shown in an open configuration in which the front and rear sections, as well as the inwardly folding wing sections have been unfolded to provide back support to a seated user.

FIG. 5A is a partial perspective view of another embodiment of a backpack convertible to a chair consistent with the present disclosure, the backpack 500 being shown in an open configuration in which the front and rear sections 512 and 514, as well as the inwardly folding wing sections 520*a*, 520*b*, 522*a*, and 522*b*, have been unfolded to provide back support to a seated user. In the embodiment of FIG. 5A, wing sections 520*a* and 520*b* are attached, affixed, or otherwise secured to or along the exterior surface 524 defined by first section 512. Likewise, wing sections 522*a* and 522*b* are attached, affixed, or otherwise secured to or along exterior surface 526 defined by second section 514. A pair of retention strap assembles, as strap assembly 562 comprising lower retention strap 562*a*, lower retention strap 562*b*, strap connector 564*b*, and reinforcing webs 568*a* and 568*b*, secure the first and second sections 512 and 514 in the chair configuration depicted in FIG. 5A. Stiffening members, as member 519*b*, are sewn into or otherwise fixed to each wing section so as remain them in the extended chair defining positions shown in FIG. 5A.

Figure 5B:
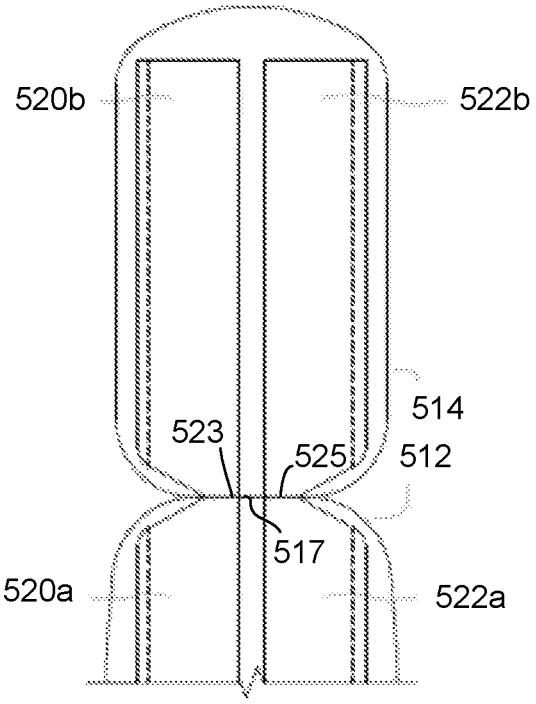
FIG. 5B is a partial elevation view of the embodiment of the backpack depicted in FIG. 5A, the backpack being in an intermediate configuration with the front and rear sections unfolded to expose both exterior surfaces in a common plane, to which pairs of inwardly folding wing sections are respectively attached but remain in their unfolded positions.
Figure 5C:
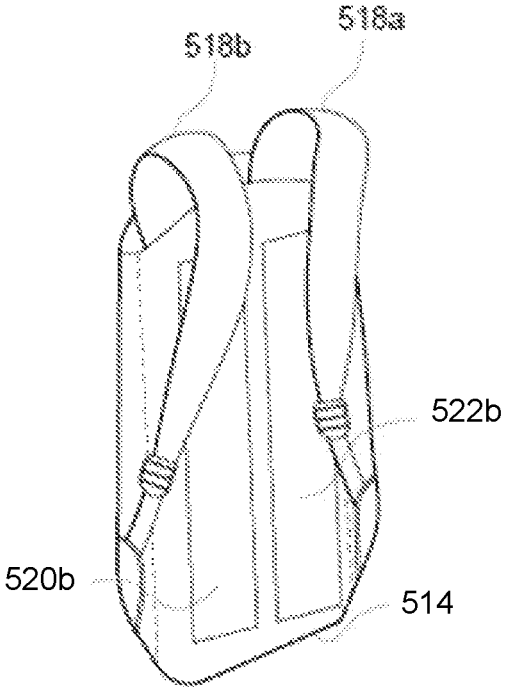
FIG. 5C is a rear perspective view of the backpack convertible chair of FIGS. 5A and 5B, the backpack being shown in a closed configuration enabling it to be worn by a user.

FIG. 5B is a partial elevation view depicting backpack 500 in an intermediate configuration with the front and rear sections 512 and 514 unfolded, after their separation (e.g. by unzipping) such that exterior surfaces 524 and 526 are disposed in a common plane to present wing sections 520*a*, 520*b*, 522*a* and 522*b* for further manipulation, but the wing sections themselves remaining in their respective unfolded condition. FIG. 5C is a rear perspective view of the backpack convertible chair 500 of FIGS. 5A and 5B, the backpack 500 includes first and second shoulder straps 518*a* and 518*b*, and/or a carrying strap (not shown) and is shown in a closed configuration enabling it to be worn and transported by a user. As can be seen in FIG. 5C, the folding wing sections as upper wing sections 520*b* and 522*b* and lower wing sections 520*a* and 522*a* (FIG. 5B) are outside of the compartment formed when the backpack 500 is zippered and in its closed configuration. To ensure these sections remain in their folded orientations, hook and loop fasteners or some other form of releasable attachment may be used to retain the folding wing sections in their folded positions.

Figure 6:
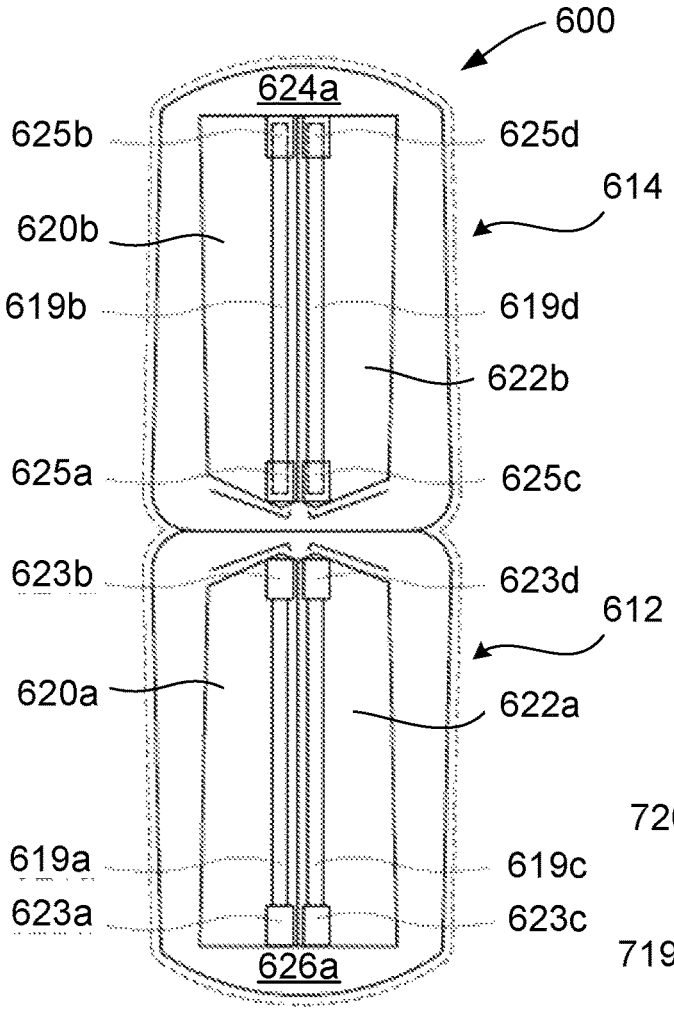
FIG. 6 is a plan view depicting a backpack convertible chair having provisions for insertable stiffeners to enhance the stability and rigidity of backpack convertible chair structures according to one or more embodiments consistent with the present disclosure.

FIG. 6 is a plan view depicting a backpack 600, which may be configured as any of the previously described embodiments, that incorporates insertable stiffeners 619*a*, 619*b*, 619*c* and 619*d* in each of wing sections 620*a*, 620*b*, 622*a* and 622*b*, respectively to obtain a chair structure having enhanced stability and rigidity. To that end, defined, attached or otherwise provided on each support surface, as first support surface 624*a* defined by first section 614 and second support surface 626*a* defined by second support surface 612, is a receiver arrangement dimensioned and arranged to receive one or more portions of each stiffener.

In some embodiments, the receiver arrangement comprises a network of receiver tubes, arranged in aligned pairs and indicated generally at 623*a*, 623*b*, 623*c*, 623*d*, 625*a*, 625*b*, 625*c*, and 625*d*. Each pair of tubes is secured to a corresponding region of first support surface 624*a* or of second support surface 626*b* and has an axial bore with an open end dimensioned and arranged to receive one end of a stiffener. The axial bore within each tube of an aligned pair, as tube 623*a*, can be closed off, as by a threaded closure structure (not shown) to prevent the unintended dislocation or loss of a stiffener. A variety of receiver arrangements may be employed, however. For example, one or more additional receiver tubes or fabric loops (not shown) may be incorporated in each wing section to provide support for each stiffener at desired intervals. In addition, or alternatively, one or both tubes of each aligned pair may be replaced with a closed fabric pocket dimensioned and arranged to receive a corresponding end of each stiffener. To facilitate insertion, each stiffener may be configured so as to have an adjustable width. By way of illustration, each stiffener may comprise a first rod (not shown) having exterior threads at one end and a second rod (not shown) defining a threaded axial bore dimensioned and arranged to receive the threaded exterior of the first rod.

Figure 7:
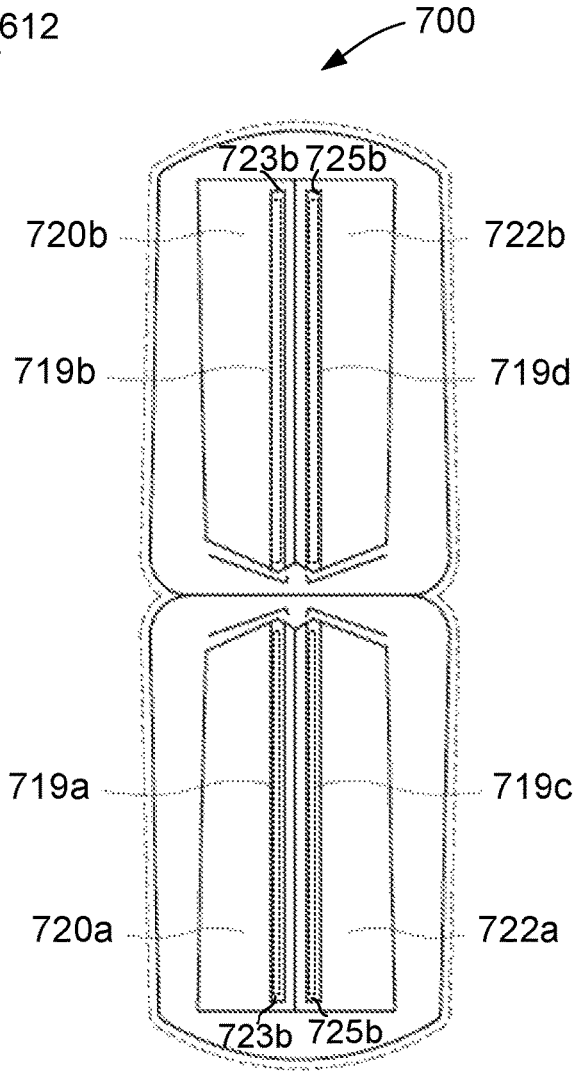
FIG. 7 is a plan view depicting a backpack convertible chair having provisions for insertable stiffeners to enhance the stability and rigidity of backpack convertible chair structures according to one or more embodiments consistent with the present disclosure.

FIG. 7 is a plan view depicting a backpack convertible chair 700 which, like the embodiment of FIG. 6, also incorporates removable stiffeners 719*a*, 719*b*, 719*c* and 719*d*. Here, however, a pair of parallel, elongated pockets are formed within, along, or upon each of inwardly folding wing sections 720*a*, 720*b*, 722*a* and 722*b*. Each of the elongated pockets, indicated generally at 723*a*, 723*b* and 725*a* and 725*b*, is dimensioned and arranged to accommodate insertion and/or removal of a corresponding one of the stiffeners 719*a*, 719*b*, 719*c* and 719*d*. Each pocket is closed at one end and open at the other end to facilitate insertion and/or removal. In yet other embodiments, each stiffener as 719*a*, 719*b*, 721*a* or 721*b* may be sewn permanently into hollow pockets defined within each wing section.

Figure 8A:
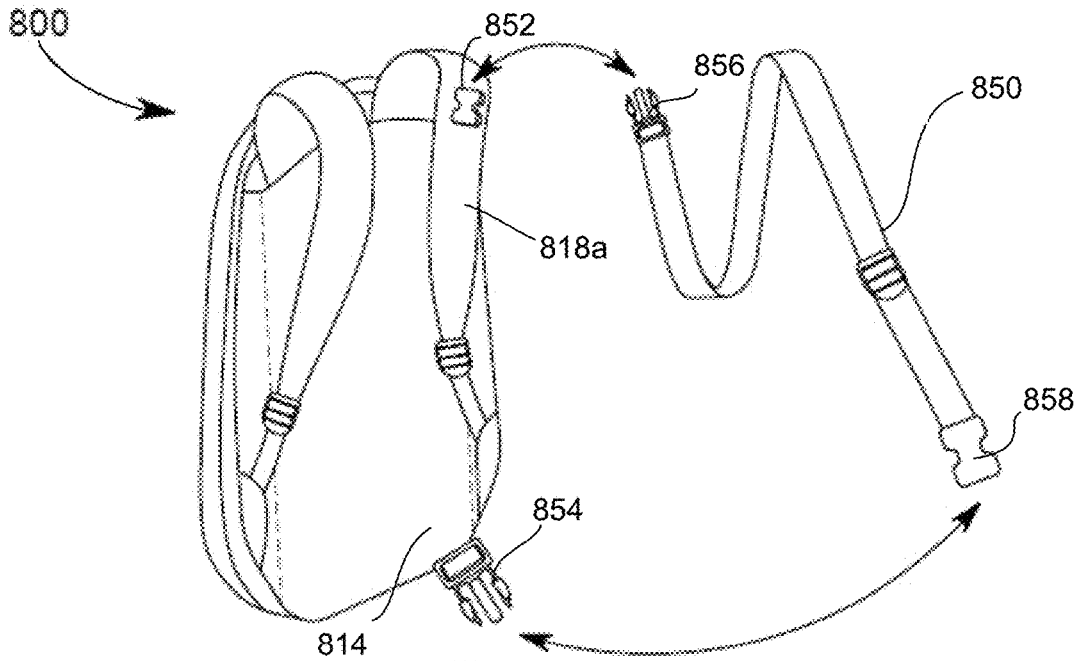
FIG. 8A is a rear perspective view depicting a backpack convertible chair having provisions for attachment of an encircling strap dimensioned and arranged to enable the wearer to support the weight of a paddleboard or surfboard according to one or more embodiments consistent with the present disclosure.
Figure 8B:
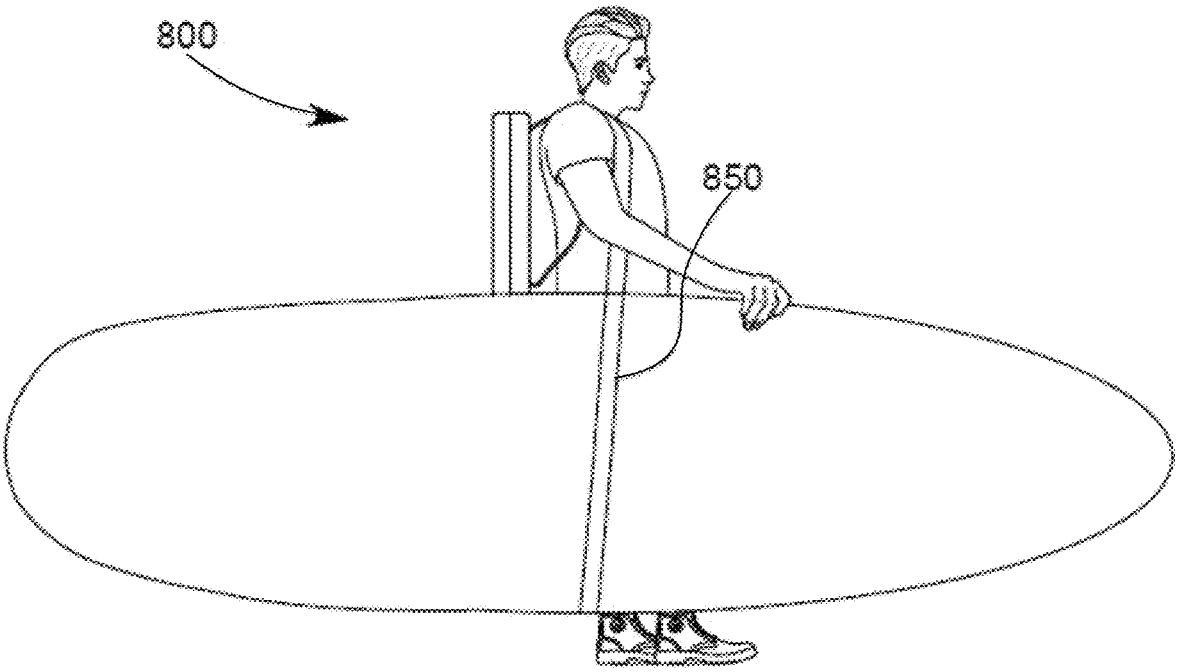
FIG. 8B is a side elevation view of the backpack convertible chair of FIG. 8A, the weight of a paddleboard or surfboard being supported by a single, encircling strap attached to upper and lower portions of the backpack according to one or more embodiments consistent with the present disclosure.

FIG. 8A is a rear perspective view depicting a backpack 800 convertible into a chair and also having provisions, such as first connector 852 and second connector 854, for attachment of an encircling strap 850 dimensioned and arranged with a corresponding connectors, as one of connectors 856 and 858, at each end thereof. Such an arrangement enables a wearer to support the weight of a paddleboard or surfboard according to one or more embodiments consistent with the present disclosure. In the embodiment of FIG. 8A, the first connector 852 is attached, affixed, formed on or otherwise secured to either of the two shoulder straps, as shoulder strap 818*a*, while the second connector 854 is attached, affixed, formed on or otherwise secured to or at a lower region of the rear section 814. FIG. 8B is a side elevation view of the backpack convertible chair of FIG. 8A, the weight of a paddleboard or surfboard being supported by the single, encircling strap 850 of backpack 800 when the connectors 856 and 858 thereof are respectively attached to connectors 852 and 854 of strap 850.

Figure 9A:
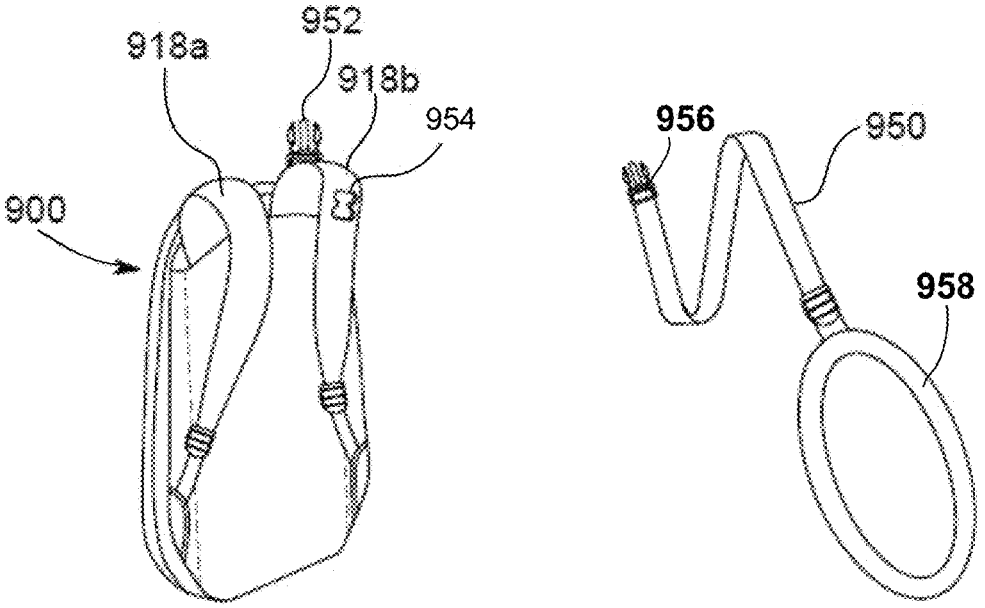
FIG. 9A is a rear perspective view depicting a backpack convertible chair having provisions for attachment of two separate accessory straps, each accessory strap having at its proximal end a releasable connector securable to a point of attachment on the backpack and at its distal and a loop dimensioned and arranged to encircle a paddleboard or surfboard, according to one or more embodiments consistent with the present disclosure.
Figure 9B:
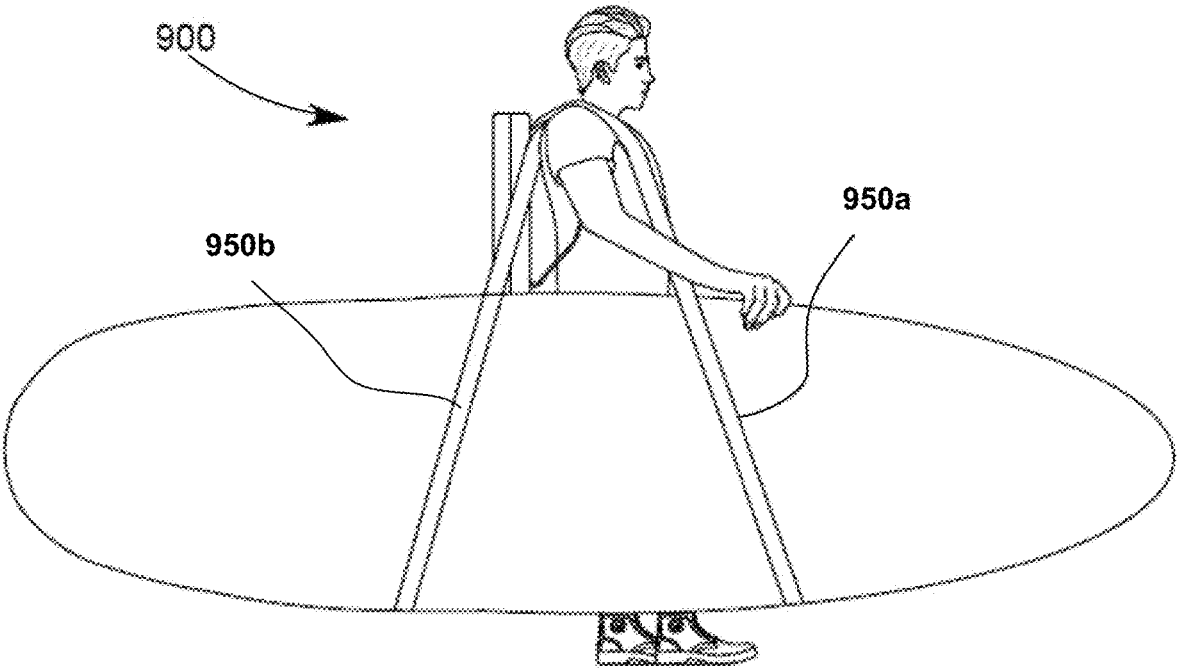
FIG. 9B is a side elevation view of the backpack convertible chair of FIG. 9A, the weight of a paddleboard or surfboard being supported by a first accessory strap attached to a forward connector of the backpack and a second accessory strap attached to a rearward connector of the backpack, according to one or more embodiments consistent with the present disclosure.

FIG. 9A is a rear perspective view depicting a backpack convertible chair 900 having provisions for attachment of two separate accessory straps 950, each accessory strap having at its proximal end a releasable connector 956 securable to a point of attachment on the backpack 900 and at its distal end a loop 958 dimensioned and arranged to encircle a paddleboard or surfboard, according to one or more embodiments consistent with the present disclosure. In the embodiment of FIG. 9A, the releasable connector 956 of each accessory strap 950 attaches to a corresponding one of two connectors 952 and 954 which, in embodiments, are secured, attached, affixed, formed, or otherwise provided on the same shoulder strap as shoulder strap 918*b*. Preferably, each accessory strap 950 has a length which is adjustable to suit the body type and/or preference of the user. FIG. 9B is a side elevation view of the backpack 900 of FIG. 9A, the weight of a paddleboard or surfboard being supported by first accessory strap 950*a* attached by a connector (not shown) as connector 956 to forward connector 952 of backpack 900 (FIG. 9A) and by a second accessory strap 950*b* attached by a connector as connector 956 (FIG. 9A) to rearward connector 954 of backpack 900, according to one or more embodiments consistent with the present disclosure.

Figure 10A:
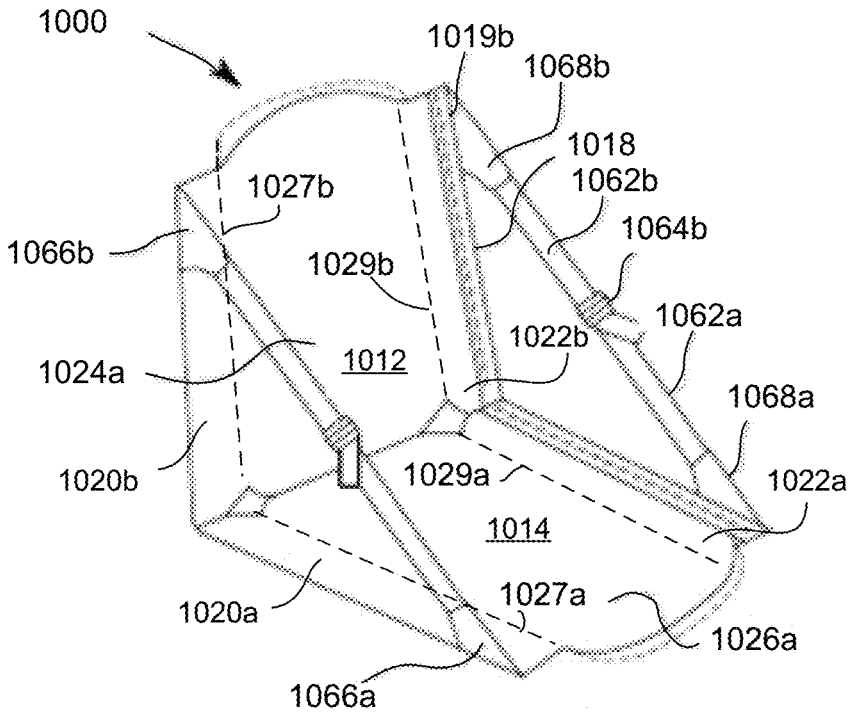
FIG. 10A is a partial perspective view of yet another embodiment of a backpack convertible to a chair consistent with the present disclosure, the backpack being shown in an open configuration in which the front and rear sections, as well as their respective inwardly folding wing sections, have been unfolded to provide back support to a seated user.

FIG. 10A is a partial perspective view of yet another embodiment of a backpack 1000 convertible to a chair in accordance with the present disclosure, the backpack 1000 being shown in an open configuration in which the front and rear sections define, respectively, a back supporting surface 1024*a* and a bottom supporting surface 1026*a*. The embodiment of FIG. 10A differs from those heretofore described in that the inwardly folding wing sections are not separately fabricated and attached to or along surfaces 1024*a* and 1026*a* but, rather, they are commonly formed with the section of material which defines those two surfaces. As depicted in FIG. 10A, the first section 1012 and second section 1014 have been unfolded, and the wing sections 1020*a*, 1020*b* of a first wing, and the wing sections 1022*a* and 1022*b* of a second wing, have been unfolded along respective fold lines 1027*a*, 1027*b*, 1029*a*, and 1029*b* and coupled together by a corresponding pair of upper and lower straps, as straps 1062*a* and 1062*b* coupled by connector 1064*b*. The other ends of the straps are coupled to reinforced web sections, as sections 1068*a* and 1066*b*, or sections 1066*a* and 1066*b*. As in the previously described embodiments, this arrangement provides back support to a seated user (not shown).

Figure 10B:
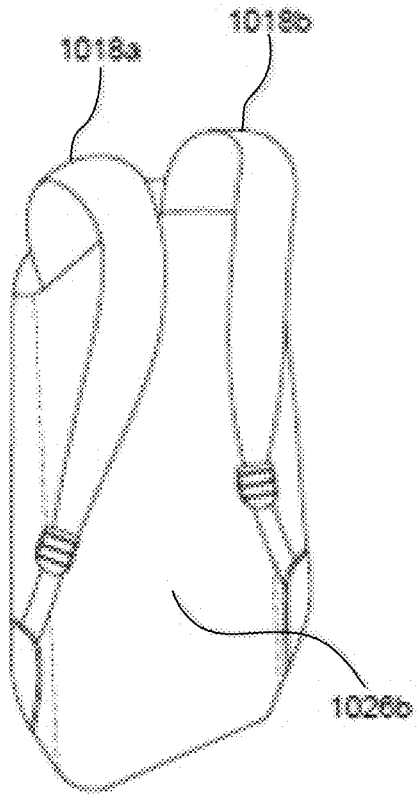
FIG. 10B is a rear perspective view of the backpack convertible chair of FIGS. 10A and 10B, the backpack being shown in a closed configuration enabling it to be worn by a user.

FIG. 10B is a rear perspective view of the backpack 1000 of FIGS. 10A and 10B, the backpack 1000 being shown in a closed configuration and having shoulder straps 1018*a* and 1018*b* enabling it to be worn by a user.

While the foregoing is directed to embodiments of the present invention, other and further embodiments of the invention may be devised without departing from the basic scope thereof, and the scope thereof is determined by the claims that follow.

What is claimed is:

1. A backpack manipulable between a compact first configuration dimensioned and arranged to be worn upon the back of a user to carry and transport articles and a second configuration to support a seated user, comprising:

a first section having a first side defining a first interior surface facing in a first direction and a second side defining a first exterior surface facing a second direction opposite the first direction while the backpack is in each of the first and second configurations, the first section including a first peripheral sidewall portion extending from and contiguous with the first interior surface of the first section to thereby form a first portion of an interior storage compartment;

a second section having a first side defining a first interior surface facing in a third direction and a second side defining a first exterior surface facing a fourth direction opposite the third direction while the backpack is in each of the first and second configurations, the second section including a second peripheral sidewall portion extending from and contiguous with the first interior surface of the second section to thereby form a second portion of an interior storage compartment;

a reversible closure mechanism dimensioned and arranged to retain edges of the first peripheral sidewall portion and the second peripheral sidewall portion in aligned arrangement to thereby form an enclosed interior compartment from the first and second sections, wherein the first exterior surfaces of the first section and second section remain outside of the interior storage compartment while the first interior surface of the first section and the first interior surface of the second section are maintained in facing relation by the reversible closure mechanism;

a first inwardly foldable wing having a first wing section extending from a first fold line along one of the first interior surface or the first exterior surface of the first section, the first wing section including a first elongated stiffener extending along at least a portion of a length thereof, and a second wing section extending from a second fold line along one of the first interior surface or the first exterior surface of the second section, the second wing section including a second elongated stiffener extending along at least a portion of a length thereof; and a second inwardly foldable wing having a third wing section extending from a third fold line along one of the first interior surface or the first exterior surface of the first section, the third wing section including a third elongated stiffener extending along at least a portion of a length thereof, and a fourth wing section extending from the fourth fold line along one of the first interior surface or the first exterior surface of the second section, the fourth wing section includes a fourth elongated stiffener extending along at least a portion of a length thereof.

2. The backpack of claim 1, wherein a region of the first peripheral sidewall portion contiguous with the second peripheral sidewall portion comprises a web of fabric material dimensioned and arranged to flexibly couple the first section to the second section.

3. The backpack of claim 1, wherein the reversible closure mechanism is a zipper.

4. The backpack of claim 1, wherein the first fold line is disposed along the first interior surface of the first section, the second fold line is disposed along the first interior surface of the second section, the third fold line is disposed along the first interior surface of the first section, and the fourth fold line is disposed along the first interior surface of the second section.

5. The backpack of claim 4, further including a first adjustable length strap dimensioned and arranged to releasably interconnect a distal end of the first wing section to a distal end of the second wing section and a second adjustable length strap dimensioned and arranged to releasably interconnect a distal end of the third wing section and a distal end of the fourth wing section to thereby allow a back support defined by the interior surface of the first section to be arranged at a desired degree of recline relative to a seat support defined by the interior surface of the second section.

6. The backpack of claim 5, wherein each of the first foldable wing and the second foldable wing are formed from segments of material separate from one another.

7. The backpack of claim 6, wherein each of the first foldable wing and the second foldable wing are formed from segments of woven material distinct from a section of woven material defining the first interior surface of the first section and the first interior surface of the second section.

8. The backpack of claim 1, wherein the first fold line is disposed along the first exterior surface of the first section, the second fold line is disposed along the first exterior surface of the second section, the third fold line is disposed along the first exterior surface of the first section, and the fourth fold line is disposed along the first exterior surface of the second section.

9. The backpack of claim 8, further including a first adjustable length strap dimensioned and arranged to releasably interconnect a distal end of the first wing section to a distal end of the second wing section and a second adjustable length strap dimensioned and arranged to releasably interconnect a distal end of the third wing section and a distal end of the fourth wing section to thereby allow a back support defined by the exterior surface of the first section to be arranged at a desired degree of recline relative to a seat support defined by the exterior surface of the second section.

10. The backpack of claim 9, wherein each of the first inwardly foldable wing and the second foldable wing are formed from segments of material separate from one another.

11. backpack of claim 10, wherein each of the first inwardly foldable wing and the second inwardly foldable wing are formed from segments of woven material distinct from a section of woven material defining the first interior surface of the first section and the first interior surface of the second section.

12. The backpack of claim 1, wherein at least one of the elongated stiffeners is sewn permanently into each of the first section and the second section.

13. The backpack of claim 1, wherein at least one of the elongated stiffeners is insertable into respective receives formed in or secured to a corresponding one of the first and second sections.

14. The backpack of claim 1, wherein the first wing section extends from the second wing section along a first transverse fold line, wherein the third wing section extends from the fourth wing section along a second transverse fold line, and wherein each of the first elongated stiffener and the second elongate stiffener extend in directions transverse to the first transverse fold line and each of the third elongate stiffener and the fourth elongate stiffener extend in directions transverse to the second transverse fold line.

15. The backpack of claim 1, further including a pair of shoulder straps to facilitate wearing of the backpack by a user.

16. The backpack of claim 1, further including a first adjustable length strap dimensioned and arranged to releasably interconnect a distal end of the first wing section to a distal end of the second wing section and a second adjustable length strap dimensioned and arranged to releasably interconnect a distal end of the third wing section and a distal end of the fourth wing section to thereby allow a back support defined by the interior surface of the first section to be arranged at a desired degree of recline relative to a seat support defined by the interior surface of the second section.

17. The backpack of claim 1, further including a first adjustable length strap dimensioned and arranged to releasably interconnect a distal end of the first wing section to a distal end of the second wing section and a second adjustable length strap dimensioned and arranged to releasably interconnect a distal end of the third wing section to a distal end of the fourth wing section.

18. A backpack manipulable between a first configuration dimensioned and arranged to be worn upon the back of a user to carry and transport articles and a second configuration to support a seated user, comprising:

a first section having a first side defining a first interior surface facing in a first direction and a second side defining a first exterior surface facing a second direction opposite the first direction, the first section including a first peripheral sidewall portion extending from and contiguous with the first interior surface of the first section to thereby form a first portion of an interior storage compartment;

a second section having a first side defining a first interior surface facing in a third direction and a second side defining a first exterior surface facing a fourth direction opposite the third direction, the second section including a second peripheral sidewall portion extending from and contiguous with the first interior surface of the second section to thereby form a second portion of an interior storage compartment;

a reversible closure mechanism dimensioned and arranged to retain edges of the first peripheral sidewall portion and the second peripheral sidewall portion in aligned arrangement to thereby form an enclosed interior storage compartment from the first and second sections, wherein the first exterior surfaces of the first section and second section remain outside of the interior storage compartment while the backpack is maintained in the compact first configuration and the first exterior surface of the first section diverges from the first exterior surface of the second section while the backpack is maintained in the second configuration;

a first inwardly foldable wing having a first wing section extending from a first fold line along one of the first interior surface or the first exterior surface of the first section, and a second wing section extending from a second fold line along one of the first interior surface or the first exterior surface of the second section, wherein the first wing section extends from the second wing section along a first transverse fold line; and a second inwardly foldable wing having a third wing section extending from a third fold line along one of the first interior surface or the first exterior surface of the first section, and a fourth wing section extending from a fourth fold line along one of the first interior surface or the first exterior surface of the second section, wherein the third wing section extends from the fourth wing section along a second transverse fold line.

19. The backpack of claim 18, wherein the first wing section including a first elongated stiffener extending between an end region of the first wing section and the first transverse fold line, wherein the second wing section including a second elongated stiffener extending between an end region of the second wing section and the first transverse fold line;

wherein the third wing section including a third elongated stiffener extending between an end region of the third wing section and the second transverse fold line; and wherein the fourth wing section including a fourth elongated stiffener extending between an end region of the fourth wing section and the second transverse fold line.

20. The backpack of claim 19, wherein the first elongated stiffener extends and is oriented in a direction parallel to the first fold line, wherein the second elongated stiffener extends in a direction substantially parallel to the second fold line, wherein the third elongated stiffener extends in a direction substantially parallel to the third fold line, wherein the fourth elongated stiffener extends in a direction substantially parallel to the fourth fold line, and wherein each of the elongated stiffeners is dimensioned and arranged to add rigidity to the first and second inwardly foldable wings while one of interior or exterior surfaces are supporting a seated user.

21. The backpack of claim 20, further including a first adjustable length strap dimensioned and arranged to releasably interconnect the end region of the first wing section to the end region of the second wing section and a second adjustable length strap dimensioned and arranged to releasably interconnect the end region of the third wing section and the end region of the fourth wing section to thereby allow a back support defined by the exterior surface of the first section to be arranged at a desired degree of recline relative to a seat support defined by the exterior surface of the second section.

22. A backpack manipulable between a compact first configuration dimensioned and arranged to be worn upon the back of a user to carry and transport articles and a second configuration to support a seated user, comprising:

a first section having a first side defining a first interior surface facing in a first direction and a second side defining a first exterior surface facing a second direction opposite the first direction while the backpack is in each of the first and second configurations, the first section including a first peripheral sidewall portion extending from and contiguous with the first interior surface of the first section to thereby form a first portion of an interior storage compartment;

a second section-having a first side defining a first interior surface facing in a third direction and a second side defining a first exterior surface facing a fourth direction opposite the third direction while the backpack is in each of the first and second configurations, the second section including a second peripheral sidewall portion extending from and contiguous with the first interior surface of the second section to thereby form a second portion of an interior storage compartment;

a reversible closure mechanism dimensioned and arranged to retain edges of the first peripheral sidewall portion and the second peripheral sidewall portion in aligned arrangement to thereby form an enclosed interior compartment from the first and second sections, wherein the first exterior surfaces of the first section and second section remain outside of the interior storage compartment while the first interior surface of the first section and the first interior surface of the second section are maintained in facing relation by the reversible closure mechanism;

a first inwardly foldable wing having a first wing section extending from a first fold line along one of the first interior surface or the first exterior surface of the first section, the first wing section including a first elongated stiffener extending along at least a portion of a length thereof, and a second wing section extending from a second fold line along one of the first interior surface or the first exterior surface of the second section, the second wing section including a second elongated stiffener extending along at least a portion of a length thereof; and a second inwardly foldable wing having a third wing section extending from a third fold line along one of the first interior surface or the first exterior surface of the first section, the third wing section including a third elongated stiffener extending along at least a portion of a length thereof, and a fourth wing section extending from a fourth fold line along one of the first interior surface or the first exterior surface of the second, the fourth wing second including a fourth elongated stiffener extending along at least a portion of a length thereof, and wherein the interior compartment is an interior storage compartment defined by maintaining the first and second wings in a folded orientation, the backpack further including at least one fastening structure for securing the first and second wings together.

23. The backpack of claim 22, wherein the at least one fastening structure includes at least one of snaps, buttons, ties, buckles, or hook and loop fasteners.

* * * * *